United States Patent [19]

Steiman

[11] 4,018,237

[45] Apr. 19, 1977

[54] BOOKLET TYPE COSMETIC COMPACT

[76] Inventor: Wolf Steiman, 649 Springer Road, Fairfield, Conn. 06430

[22] Filed: Oct. 14, 1975

[21] Appl. No.: 622,026

[52] U.S. Cl. ..... 132/83 R
[51] Int. Cl.[2] ..... A45D 33/00
[58] Field of Search ..... 132/83 R, 83; 150/37

[56] References Cited

UNITED STATES PATENTS

| | | | |
|---|---|---|---|
| 2,811,768 | 11/1957 | Axelson | 132/83 R |
| 3,256,892 | 6/1966 | Esposito, Jr. | 132/83 R |
| 3,619,596 | 11/1971 | Jackson | 132/83 X |

FOREIGN PATENTS OR APPLICATIONS

| | | | |
|---|---|---|---|
| 855,103 | 11/1960 | United Kingdom | 132/83 R |

*Primary Examiner*—G.E. McNeill
*Attorney, Agent, or Firm*—H. Gibner Lehmann; K. Gibner Lehmann

[57] ABSTRACT

A cosmetic compact in the form of a small booklet of flexible sheet material comprising a one-piece base and cover, the latter being hingedly connected to the base and adapted to overlie the same. Heat-sealed to the members are substantially flat retainer sheets, both of which are provided with upstanding bead formations extending at least partially around peripheral edge portions thereof. The bead formations of each sheet are so arranged as to be capable of interfitting with one another and being frictionally nested, thereby to maintain the members in closed position when compact is not in use. Optionally, one or both of the bead formations can be provided with undercut surfaces to thereby improve the frictional retention between the two members. The flat space outlined by the bead formation of the base member is adapted to receive a tray of cosmetic material, and the space outlined by the bead formation of the cover member is available for securing a mirror thereto. The arrangement is such that an especially neat external appearance and soft touch is realized, in a compact characterized by small physical size and extremely low manufacturing cost.

10 Claims, 10 Drawing Figures

BOOKLET TYPE COSMETIC COMPACT

BACKGROUND

This invention relates to cosmetic compacts of the type comprising a base member and a cover member hingedly connected thereto, wherein one of the members is adapted to carry a cosmetic product and the other to hold a mirror.

In the past a number of cosmetic compacts of various types have been proposed and produced. In almost all cases heretofore known, the base and cover members were constituted of separate parts, either of metal or plastic. Molded plastic compacts typically had integral molded hinges which were joined together by means of a metal hinge-pin or the like. Mirror members were generally secured in place by either a press fit or else by suitable adhesive. The closure function was obtained by means of a detent catch, the parts of which were disposed on each member generally opposite the location of the molded hinge. Cosmetic substance was typically deposited in a dish-shaped recess in one of the members, or alternately in a separate tray which was received in the recess.

While the above compacts for years had good acceptance, a number of disadvantages were apparent. Molding of plastic components is generally an expensive process, involving carefully constructed mold cavities, together with heated liquid plastic product which must be injected therein. The dimensions and tolerances involved with such molds were often critical, especially in the vicinity of the hinges and in the area around the detent catch. Such close tolerances were necessary in order to insure satisfactory performance of the hinge and detent mechanisms. Where separate hinge-pins were employed, there was required an additional step in the assembly of the compact, involving the alignment of the hinge parts of each of the members and the insertion of the pin. Such a procedure was time consuming and in some cases difficult to achieve, particularly if the dimensions of the molded hinges were not precisely controlled.

In addition to being costly to manufacture, prior compacts frequently proved unsatisfactory in use. Problems occurred when the compact halves were opened past a predetermined point, this often resulting in cracking or breaking of one or both of the hinge parts which joined the members together. Such breakage tended to completely defeat the closure feature of these devices. In addition, considerable trouble was frequently encountered in opening such compacts, particularly where the dimensions of the detent catch mechanism were not maintained within sufficient limits. Also, molded rigid plastic parts were generally subject to breakage, particularly if they were dropped on a hard surface or forcibly distorted. As a result, such prior cosmetic compacts often constituted a substantial inconvenience to the typical consumer.

SUMMARY

The above drawbacks and disadvantages of prior cosmetic compact devices are obviated by the present invention, which has for an object the provision of a novel and improved compact in the form of a small booklet of tough, flexible sheet material, which is extremely simple in its construction, soft to the touch, reliable in operation and inexpensive to manufacture. A related object of the invention is the provision of a cosmetic compact as above, which features a reliable closure function without requiring especially critical dimensions or tolerances. Still another object of the invention is the provision of a compact in accordance with the foregoing, which requires minimum assembly time and does not involve either conventional hinge or detent catch mechanisms that are subject to malfunction and/or breakage.

The above objects are accomplished by the provision of a cosmetic compact construction constituted of flexible sheet material in the form of a small padded booklet, the compact comprising a base member, a cover member hingedly connected thereto by means of a living hinge, and a pair of flat plastic retainer sheets carried by the members respectively, such sheets having upstanding bead formations extending around peripheral edge portions thereof. Preferably, heat sealed joints are utilized for securing the retainer sheets to the corresponding members. The bead formations of each of the sheets are adapted to frictionally engage and nest in one another when the cover member is swung to a position overlying the base member, so as to maintain the members in such position when the compact is closed and not in use. The base and cover members are constituted as a padded laminate, with spongy material between two facings; they are made one-piece or integral with one another, and the retainer sheets are also integral or formed of one piece. During manufacture, the base and cover members, after being cut and formed, are attached to the preformed retainer sheets by a heat-sealing operation so as to constitute a unitary assemblage. The areas bounded by or between the bead formations define shallow recesses to respectively receive a mirror and a quantity of cosmetic material, such as powder, eye shadow, etc. By this arrangement an extremely simple assemblage is realized, without reliance on molded plastic parts which are subject to breakage. Manufacturing cost is kept to an absolute minimum. In addition, the foldable compact provides a desirably soft feel and an extremely pleasing external appearance, thus contributing to its appeal as a consumer product.

Other features and advantages will hereinafter appear.

In the drawings, illustrating several embodiments of the invention:

Referring to FIGS. 1–8 and in accordance with the present invention there is provided an improved cosmetic compact in the form of a small booklet of tough, flexible sheet material, comprising a base member 12 and a cover member 14 connected thereto by means of a living hinge. Both the base member 12 and the cover member 14 are constituted of flexible, sheet-like plastic material such as polyvinylchloride or the like.

Figure 4:
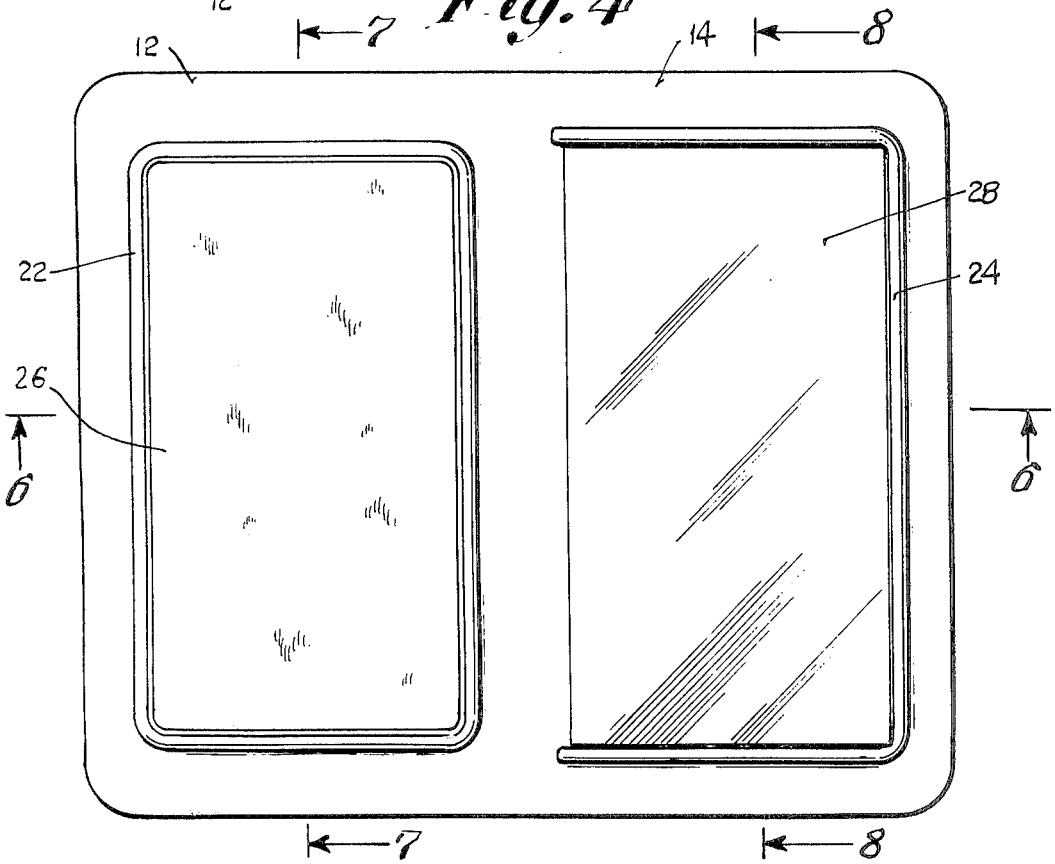
FIG. 4 is a plan view of the compact of FIGS. 1–3, shown in the open position and revealing the bead formations carried respectively by the base member and cover member.
Figure 6:
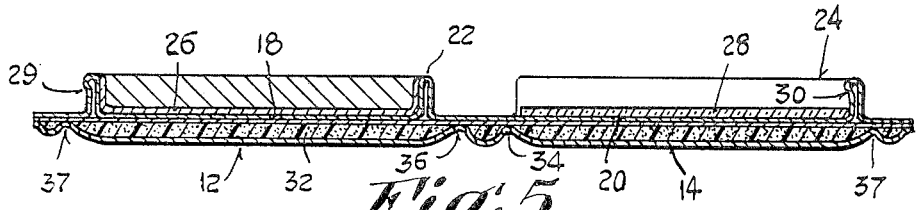
FIG. 6 is a section taken on line 6—6 of FIG. 4.
Figure 5:
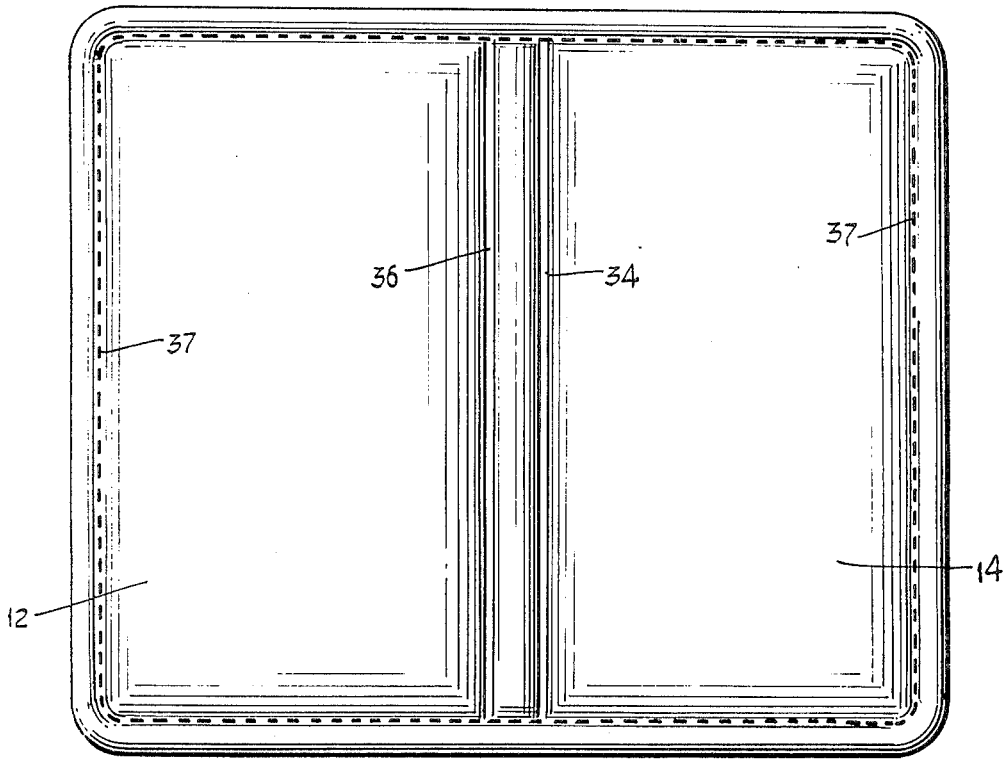
FIG. 5 is a plan view of the opposite face of the compact of FIGS. 1–4, shown in the open position and revealing two creased portions disposed between the base member and the cover member, the creased portions constituting a "living" hinge.
Figure 7:
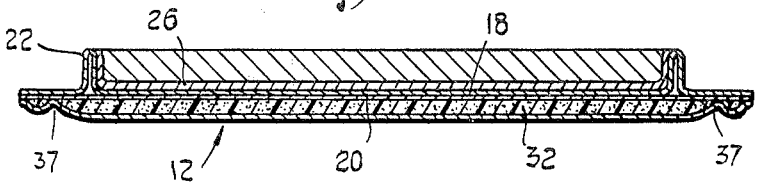
FIG. 7 is a section taken on line 7—7 of FIG. 4.
Figure 8:
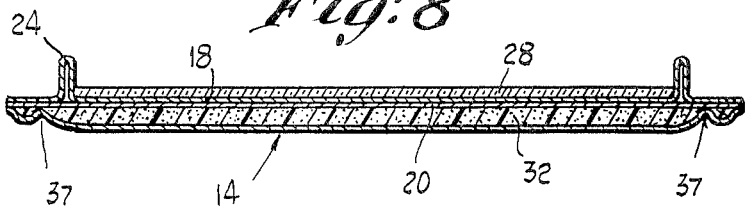
FIG. 8 is a section taken on line 8—8 of FIG. 4.

As particularly illustrated in FIGS. 4 and 6, a substantially flat retainer sheet 18 is secured to the base member 12 by means of a heat-sealing process which bonds peripheral edge portions of the sheet thereto. In a similar manner, the cover member 14 includes a retainer sheet 20 which is also heat sealed thereto along its peripheral edge portions.

As provided by the invention, the retainer sheet 18 is preformed prior to its assembly, and includes an upstanding bead formation 22 which is constituted as a downwardly facing hollow channel, illustrated in FIG. 6, and which extends about the periphery of the base member 12 to form a rectangle having opposite side edges which are parallel to the side edges of the member. In a similar manner, the cover member 14 by virtue of its having the attached retainer sheet 20, can be thought of as being provided with an upstanding bead formation 24 which is also constituted as a hollow, downwardly facing channel, illustrated in FIGS. 4 and 6. The formation 24 is shown as extending along three peripheral side portions of the cover member 14. By such an arrangement there are formed two relatively shallow recesses, one of which is adapted to receive a tray 26 containing a quantity of cosmetic material such as powder, eye shadow, etc., the other recess being adapted to receive a mirror 28 (shown in FIGS. 6 and 8). The beads 22, 24 are vacuum formed in the sheets 18, 20 prior to their being sealed to the members 12, 14 respectively.

Figure 1:
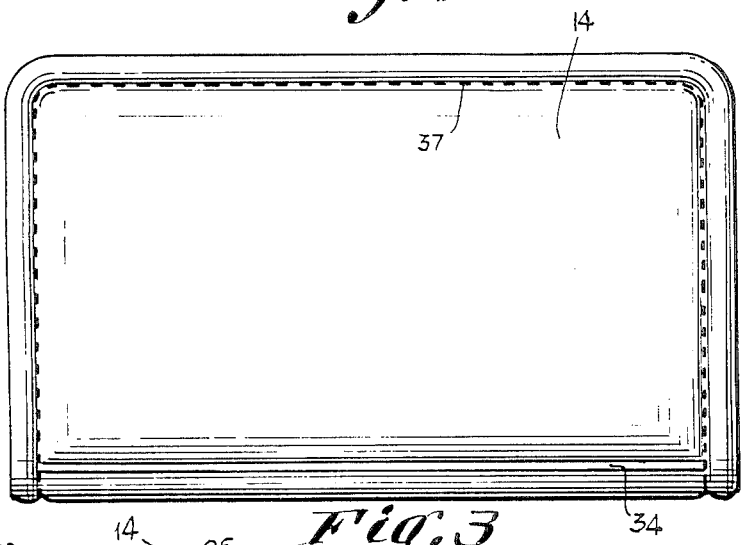
FIG. 1 is a plan view of the cosmetic compact of the present invention, shown in the closed position.
Figure 2:
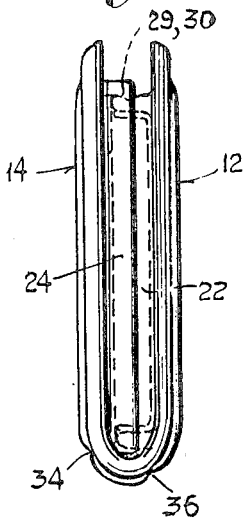
FIG. 2 is a right end elevational view of the compact of FIG. 1.
Figure 3:
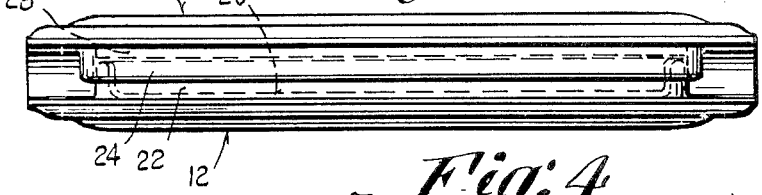
FIG. 3 is a front elevational view of the compact of FIGS. 1 and 2.

As particularly illustrated in FIG. 6, certain portions of the bead formations 22, 24 can be provided with undercut configurations 29, 30 respectively, such that when the compact is folded to the closed position of FIG. 2, the undercut configurations frictionally engage one another so as to retain the compact in the closed condition. It will be understood that the bead formations 22, 24, being constituted of plastic having extremely thin wall, are not rigid, but instead somewhat yieldable, so as to tolerate any slight misalignment between them as the compact is closed.

As illustrated in FIG. 6, in order to provide a soft feel to the outer surface of the casing, the members 12, 14 may each be constituted as a laminate consisting of two outer layers of material with a layer of sponge plastic 32 included between the two. Such an arrangement provides a desirable soft feel to the cover, which it would otherwise not have were the sponge material not included.

The base and cover members 12, 14 are preferably formed as a single, integral piece, the same being true of the two retainer sheets 18, 20. During the fabrication of the base and cover members, the sponge material is placed between the outer layers of the members and the layers heat-sealed together along their peripheral edge portions. At the same time that this is done, creased portions 34, 36 are formed, the creased portions constituting the "living" hinge which enables the cover member and base member to be folded one upon the other to the position of FIG. 2. In order to provide an ornamental appearance to the compact, a series of artificial stitches 37 is provided, extending around the peripheral edge portions of the open or unfolded compact, this being particularly illustrated in FIG. 5. These are imparted to the compact during the heat-sealing process which joins the layers together.

Figure 9:
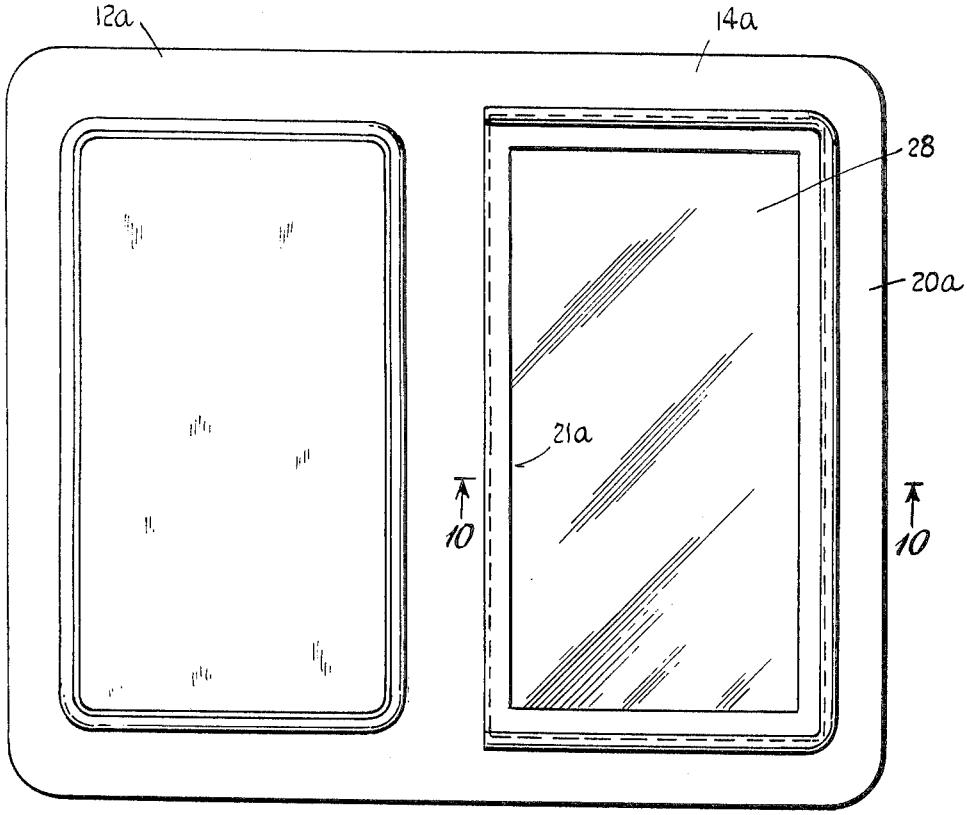
FIG. 9 is a plan view of another embodiment of the invention, wherein a mirror is held at its peripheral edge portions by means of the retainer sheet carried by one of the above members.
Figure 10:
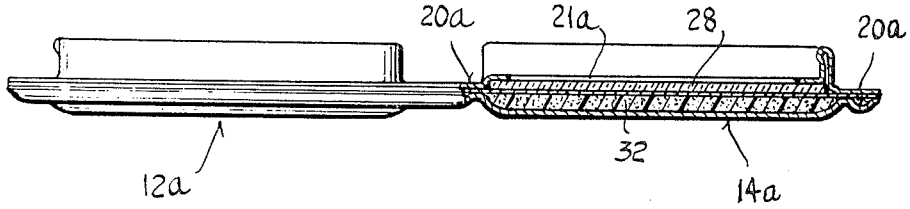
FIG. 10 is a view, partly in end elevation and partly in section, taken on line 10—10 of FIG. 9.

Another embodiment of the invention is illustrated in FIGS. 9 and 10 showing a slightly modified compact having unique retainer means for the mirror 28. The compact includes a base member 12*a* and a cover member 14*a* hingedly secured thereto, with retainer sheets 18*a*, 20*a* which may be integral with one another as in the previous embodiment. By the present invention, the retainer sheet 20*a* includes a window 21*a* whose edge portions are adapted to overlie peripheral edge portions of the mirror 28 thereby securing it in place. The mirror can either be inserted through the window after the fabrication of the compact is completed, or alternately can be placed over the cover member just prior to the heat-sealing of the retainer sheet 20*a* to the member 14*a*. Both arrangements have been found to provide equally satisfactory results.

Such a construction is thus seen to provide a neat and reliable arrangement for mounting the mirror, and for protecting it against chipping or breakage during use of the compact.

The above constructions have a number of distinct advantages. First, reliance on a mechanical hinge is not required. The living hinge provides excellent performance over extended periods of use. In the event that the compact is inadvertently folded beyond its fully open position illustrated in FIG. 6, little or no damage to the living hinge will occur. As a result, there are eliminated the problems with breakage which were so often encountered in prior compact devices. Second, by virtue of the simple construction of the compact, manufacturing cost is held to an absolute minimum. The sheet constituting the outer surface of the base member 12 and the cover member 14 can be constituted as a separate piece, with the integral assemblage of retainer sheets 18, 20 applied thereto and sealed by means of a relatively inexpensive heat-sealing process. The arrangement is such that, upon completion of the heat-sealing process, the compact is ready for installation of a suitable cosmetic carrying tray and mirror. By virtue of the bead formations 22, 24 being somewhat yieldable, problems with misalignment between them are greatly minimized, thus insuring that they can readily frictionally engage one another in the position of FIG. 2 in order to retain the compact in the closed condition. In addition, due to the flexible nature of the material of which the compact is constituted, the likelihood of the mirror becoming dislodged or broken if the compact is inadvertently dropped is greatly minimized, shock resistance being supplied to an extent by the outer layers of the base and cover members 12, 14, respectively as well as by the sponge insert 32.

From the above it can be seen that I have provided a novel and improved booklet-type cosmetic compact which is simple in construction, extremely inexpensive to manufacture, and which provides a very pleasing exterior appearance not found in other cosmetic compacts of this type. The device is highly damage resistant, and lends itself to mass production techniques. It is thus seen to represent a distinct advance and improvement in cosmetic dispenser technology.

Variations and modifications are possible without departing from the spirit of the invention.

I claim:

1. As a new article of manufacture, a cosmetic compact in the form of a small booklet which includes a single outer piece of tough, flexible sheet material, said booklet having front and rear cover portions and comprising:

a. a base member of flexible and soft sheet-like material, b. a cover member of flexible and soft sheet-like material hingedly connected to and adapted to overlie the base member, c. a substantially flat retainer sheet carried by one of said members, said sheet having an upstanding yieldable bead formation extending at least around three peripheral side edge portions thereof, d. means for securing said retainer sheet to said one member, e. a second substantially flat retainer sheet carried by the other of said members, said second sheet having an upstanding yieldable bead formation extending at least partially around its periphery, and f. means for securing said second retainer sheet to said other member, g. said bead formations being adapted to overlie and frictionally engage and nest with one another when the cover member is swung to a closed position overlying the base member, thereby to maintain the members in the closed position when the compact is not in use, h. said base member and cover member being formed of a single sheet whereby they are integral with one another, said single sheet having intermediate portions constituting a "living" hinge.

2. The invention as defined in claim 1, wherein:

a. said first retainer sheet securing means comprises heatsealed edge portions thereof, fused to corresponding underlying portions of said one member.

3. The invention as defined in claim 1, wherein:

a. the bead formations of said retainer sheets comprise upstanding hollow channels formed in the retainer sheets respectively, b. said channels being vacuum-formed prior to securement of the retainer sheets to the members.

4. The invention as defined in claim 1, wherein:

a. a portion of at least one of said bead formations comprises an undercut surface to provide improved nesting capability with respect to the other of the bead formations.

5. The invention as defined in claim 1, wherein:

a. the bead formations of one retainer sheet are arranged to form a rectangle having its opposite sides adjacent to the peripheral edge portions of the member to which it is secured, b. inner edge portions of said formations forming, with other parts the retainer sheet, a compartment to hold cosmetic product.

6. The invention as defined in claim 1, and further including:

a. a mirror, and b. means for securing the mirror to one of said members with the silvered surface of the mirror reflecting outward.

7. The invention as defined in claim 6, wherein:

a. one of said retainer sheets has a central aperture, b. said mirror securing means comprising edge portions of said one retainer sheet at said aperture such that corresponding edge portions of the mirror are sandwiched between the said one retainer sheet and its carrier member.

8. The invention as defined in claim 5, and further including:

a. a mirror, b. the bead formations of the other of said retainer sheets being arranged to form a U-shaped enclosure having two opposite sides adjacent to opposite peripherial edge portions of its carrier member, c. said U-shaped enclosure being adapted to confine edge portions of the mirror.

9. The invention as defined in claim 1, wherein:

a. said base member and cover member are each constituted of two layers of heat-softenable material fused together at their peripheral edge portions, and b. sponge sheet material disposed between said layers to provide a soft, cushion-like feel to the exterior of the members.

10. The invention as defined in claim 1, and further including:

a. a series of heat-formed simulated stitches on peripheral edge portions of the members to enhance the appearance of the compact.

* * * * *